United States Patent [19]

Montano

[11] 4,047,718

[45] Sept. 13, 1977

[54] TOY GAMING DEVICE

[76] Inventor: Angelo Montano, 847 E. 232 St., Apt. 3A, Bronx, N.Y. 10466

[21] Appl. No.: 726,644

[22] Filed: Sept. 27, 1976

[51] Int. Cl.[2] ..... A63B 67/10

[52] U.S. Cl. ..... 273/98

[58] Field of Search ..... 273/98, 95 R, 95 A, 273/95 AA, 96 R, 97 R

[56] References Cited

U.S. PATENT DOCUMENTS

| | | | |
|---|---|---|---|
| 163,294 | 5/1875 | Bass | 273/97 R |
| 2,042,984 | 6/1936 | Fritz | 273/97 R X |
| 2,999,692 | 9/1961 | Di Pietro | 273/98 X |
| 3,365,839 | 1/1968 | Luchsinger | 273/95 A X |
| 3,391,935 | 7/1968 | Gross | 273/96 R |
| 3,409,299 | 11/1968 | Yoneshige | 273/98 |
| 3,685,827 | 8/1972 | Petrusek | 273/98 |
| 3,687,453 | 8/1972 | Fraga | 273/97 R |

*Primary Examiner*—William H. Grieb

[57] ABSTRACT

A toy comprising elongated handle means having a front end with a base mounted at the rear end thereof and being suitable for holding in the hand, with lighting means including a lamp mounted within the handle means and including a switch having a portion thereof extending outwardly above the front end of the handle such that when the switch is depressed the lamp is adapted to be energized and light is emitted therefrom, and seen through translucent means for visibly displaying the light emitted from the lamp through the handle means so as to visually inform the user of the toy when the switch is depressed. A hood having an axially extending cavity at one end thereof is adapted to receive therein the front end of the handle means in telescopic relationship to each other for activating the switch, and flexible means having one end secured to the handle means and the other end thereof secured to the hood is provided so as to suspend the hood from the handle means to swing the hood through an arc for seating upon the front end when the handle means is manipulated to the proper position such that the lighting means is activated.

10 Claims, 2 Drawing Figures

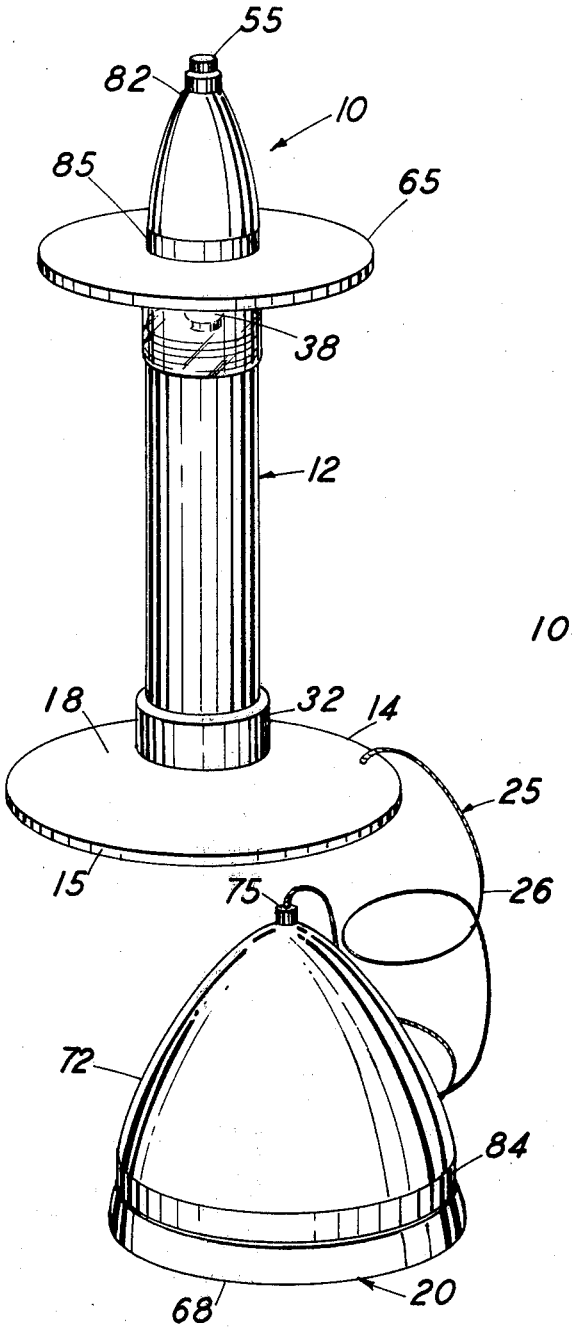
FIG. 1
FIG. 2
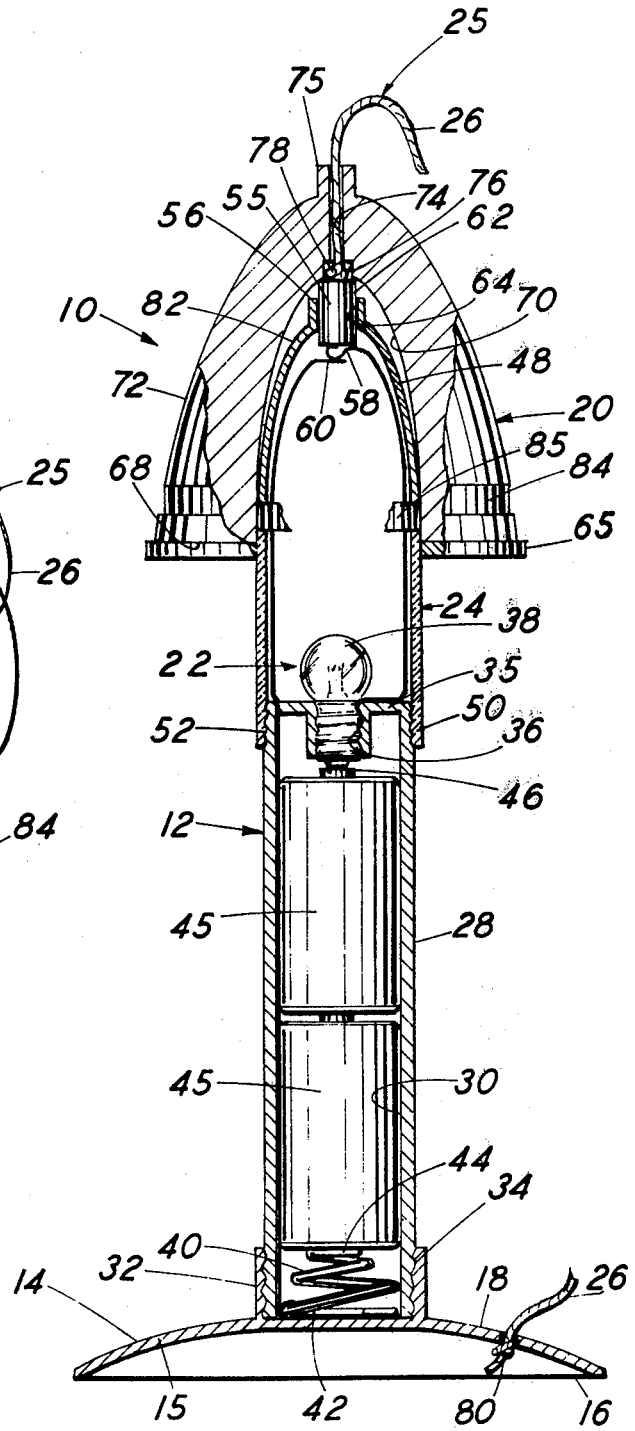

TOY GAMING DEVICE

BACKGROUND OF THE INVENTION

The present invention relates to a toy and more particularly to a juggling type of toy in which a certain degree of skill is required.

Whip toys have been used for years as an amusement device and they have varied as to the arrangement of the parts with respect thereto. In order to provide a more interesting and enjoyable device, the inventor has found that a toy of the above type having lighting means to advise the player when the hood or top has properly landed greatly adds to the amusement and novelty of the toy.

OBJECTS OF THE INVENTION

An object of the present invention is to provide a novel combination of a hood and handle, with the handle becoming illuminated when the hood lands thereon.

Another object of the present invention is to provide a toy having phosphorescent components on the handle and the hood so that it may be used at night.

Another object of the present invention is to provide a toy that is battery powered and illuminated only upon the proper positioning of the hood thereon.

Another object of the present invention is to provide a toy that may be economically manufactured and ideally suited for its intended purpose.

Other objects and advantages of the present invention will become apparent as the disclosure proceeds.

SUMMARY OF THE INVENTION

A toy comprising elongated handle means having a front end with a base mounted at the rear end thereof and being suitable for holding in the hand, with lighting means including a lamp mounted within the handle means and including a switch having a portion thereof extending outwardly above the front end of the handle such that when the switch is depressed the lamp is adapted to be energized and light is emitted therefrom, and seen through translucent means for visibly displaying the light emitted from the lamp through the handle means so as to visually inform the user of the toy when the switch is depressed. A hood having an axially extending cavity at one end thereof is adapted to receive therein the front end of the handle means in telescopic relationship to each other for activating the switch, and flexible means having one end secured to the handle means and the other end thereof secured to the hood is provided so as to suspend the hood from the handle means to swing the hood through an arc for seating upon the front end when the handle means is manipulated to the proper position such that the lighting means is activated.

The lighting means is powered by battery means adapted to extend within said handle means, with the handle means including a tubular lower section removably secured to the base at one end thereof and adapted to receive the battery means therein with the lamp extending from the other end thereof, and an upper section having one end removably secured to the lower section adjacent the lamp with the switch mounted relative to the opposite end thereof for axial displacement by the hood.

The switch includes a pair of contacts mounted in the upper section extending in a normally open position and coupled to the lamp and battery means, and a push button switch member extends within the bore in the upper section beyond the front end of the handle means for displacement against the contacts by the hood in its seated position on the handle means such that the electrical circuit is closed and the lamp illuminated. The upper section adjacent the switch is contoured in substantially conforming relationship with the shape of the cavity to facilitate the telescopic positionment therebetween, and the toy further includes a top extending radially from the handle means proximate the front end to facilitate use of the handle means by the user of the toy and retain the hood in position thereon.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 1 is a perspective view of the toy in accordance with the present invention with the hood removed therefrom; and FIG. 2 is a vertical sectional view of the toy with the hood mounted thereon.

DETAILED DESCRIPTION OF THE DRAWINGS

Referring now to the drawings, there is illustrated a toy 10 having an elongated handle 12 that is adapted to be hand held by the user who might be a child or an adult. The handle 12 includes a base 14 at one end thereof that may have a base wall 15 that may be contoured to have a circular or other shaped bottom 16 with an upper contoured surface 18. The base should be of suitable size to support the handle 12 if it is desired to utilize the toy in a gamelike fashion such that it is supported on a surface and the hood 20 to be utilized in conjunction with the handle 12 may be tossed thereon.

The handle means 12 has associated therewith lighting means 22 and translucent means 24 that operate in interrelated fashion with the hood 20 as hereinafter explained. Flexible means 25 secures the hood 20 to the handle means 12 and may be in the form of a cord 26 made from a variety of materials and having a length that is adjustable depending upon the skill of the player using the toy 10.

The handle means 12 includes a tubular vertically extending lower section 28 having a cavity 30 therein and removably secured to a sleeve 32 extending upwardly from the base 14 as by threads 34. The lower section 28 has a horizontally extending flange or top 35 adapted to receive in a threaded section 36 a lamp 38 forming part of the lighting means 22. A spring or other resilient member 40 is coaxially mounted within the sleeve 32 having one end 42 that may be secured to the base 14 and having spaced apart free end 44. Battery means in the form of one or two batteries 45 extend axially within the cavity 30 and adapted to engage by the contacting portion 46 the lamp 38 mounted in the appropriate socket 36. In this manner the batteries are readily replaceable by the lower section 28 being removed from the base 14 from time to time in order to permit the replacement.

The handle means 12 further includes an upper section 48 having one end removably secured to the lower section 28 as by threads 52 adjacent the lamp 38. The lighting means 22 further includes a switch 55 extending outwardly above the front end 56 of the upper section 48. In this manner when the switch 55 is depressed, the lamp 38 is adapted to be energized by the batteries 45 and light emitted therefrom. The switch 55 is mounted relative to the front end 56 for axial displacement by the hood 20 when placed in the seated position illustrated in FIG. 2. The switch 55 includes a pair of metallic contacts 58 and 60 mounted within the upper section 48 and extending in a normally open position and coupled to the lamp 38 and battery means 45 in a conventional manner. The switch 55 includes a push button switch member 62 extending within a vertically extending bore 64 in the upper section 48 that terminates at the front end 56. The switch member 62 in its normal position extends beyond the front end 56 and when pressed downwardly by the weight of the hood 20 forces the contacts 58 and 60 to engage each other such that the electrical circuit is closed and the lamp illuminated.

The toy 10 may further include a top 65 extending radially from the upper section 48 of the handle means 12 and proximate the front end 56. The top 65 has an upper planar surface 66 which is adapted to receive thereon the bottom 68 of the cover 20. The top 65 facilitates the user when holding the handle means 12 to in effect partially protect it behind the top 65. Further, the top 65 acts to limit the travel of the hood 20 downwardly onto the handle means 12 such that the amount of force applied against the contacts 58 and 60 is controlled to prevent their being overstressed and possibly cracking.

The portion of the upper section 48 extending beneath the top 65 may be provided with the translucent means 24 for visibly displaying the light emitted from the lamp 38 through the handle means 12 so as to visually inform the user of the toy when the switch 55 has been closed and the hood 20 is in its seated position on the handle means 12.

The hood 20 includes an axially extending contoured cavity 70 at one end thereof which terminates at the bottom end 68 of the hood 20. The front end 56 of the handle means 12 is adapted to extend in telescopic relationship with the hood 20 for activating the switch 55 of the lighting means 22. The hood 20 has a contoured exterior configuration 72 which may be bell shaped and having a vertically extending bore 74 extending between the cavity 70 and the distal end 75 of the hood 20. A counterbore or seat 76 is provided between the bore 74 and the cavity 70. One end of the cord 26 is formed having a knot 78 contained within the seat 76. The opposite end of the cord 26 extends through the wall 15 of the base 14 and a knot 80 is similarly formed.

The exterior 82 of the upper section 48 adjacent the switch 55 is contoured in substantially conforming relationship with the shape of the cavity 70 to facilitate the telescopic positionment therebetween. The toy 10 further includes first phosphorescent means 84 adjacent the bottom end 68 of the top 20 and may be in the form of a radially extending band. Second phosphorescent means 85 is provided on the handle means 12 above the top 65 and may be in the form of a radially extending band on the upper section 48.

Accordingly, the toy 10 is ideally suited for playing of games in which the skill of the user can be determined. The user would hold the handle means 12 and fling the bell shaped hood 20 outwardly therefrom and thereafter attempt to catch it in position in the telescopic arrangement illustrated. As discussed above, the lighting means 22 is automatically activated when the proper position is reached. In this manner one catches the hood 20 to obtain the assembly thereof. The toy can be manufactured from plastic, wood, or metallic materials, as desired.

Although an illustrative embodiment of the invention has been described in detail herein with reference to the accompanying drawings, it is to be understood that the invention is not limited to the precise embodiment, and that various changes and modifications may be effected therein without departing from the scope or spirit of the invention.

I claim:

1. A toy comprising:
   a. elongated handle means having a front end with a base mounted at the rear end thereof and being suitable for holding in the hand,
   b. lighting means including a lamp mounted within said handle means and including a switch having a portion thereof extending outwardly above said front end of said handle such that when said switch is depressed said lamp is adapted to be energized and light is emitted therefrom,
   c. translucent means for visibly displaying the light emitted from said lamp through said handle means so as to visually inform the user of the toy when said switch is depressed,
   d. a hood having an axially extending cavity at one end thereof adapted to receive therein said front end of said handle means in telescopic relationship to each other for activating said switch, and
   e. flexible means having one end secured to said handle means and the other end thereof secured to said hood so as to suspend said hood from said handle means to swing said hood through an arc for seating upon said front end when said handle means is manipulated to the proper position such that said lighting means is activated.

2. A toy as defined in claim 1, wherein said lighting means is powered by battery means adapted to extend within said handle means.

3. A toy as defined in claim 2, wherein said handle means includes:
   a. a tubular lower section removably secured to said base at one end thereof and adapted to receive said battery means therein with said lamp extending from the other end thereof, and
   b. an upper section having one end removably secured to said lower section adjacent said lamp with said switch mounted relative to the opposite end thereof for axial displacement by said hood.

4. A toy as defined in claim 3, wherein said switch includes:
   a. a pair of contacts mounted in said upper section extending in a normally open position and coupled to said lamp and battery means, and
   b. a push button switch member extending within a bore in said upper section beyond said front end of said handle means for displacement against said contacts by said hood in its seated position on said handle means such that the electrical circuit is closed and said lamp illuminated.

5. A toy as defined in claim 1, wherein said upper section adjacent said switch is contoured in substantially conforming relationship with the shape of said cavity to facilitate the telescopic positionment therebetween.

6. A toy as defined in claim 1, and further including a top extending radially from said handle means proximate said front end to facilitate use of said handle means by the user of the toy and retain said hood in position thereon.

7. A toy as defined in claim 1, and further including:

a. first phosphorescent means on said hood adjacent the bottom end thereof, and b. second phosphorescent means on said handle means.

8. A toy as defined in claim 1, wherein said hood has a contoured exterior configuration and said flexible means is secured to said hood at at the upper end thereof and to said base.

9. A toy as defined in claim 1, a. wherein said lighting means is powered by battery means adapted to extend within said handle means, b. wherein said handle means includes:

1. a tubular lower section removably secured to said base at one end thereof and adapted to receive said battery means therein with said lamp extending from the other end thereof, and 2. an upper section having one end removably secured to said lower section adjacent said lamp with said switch mounted relative to the opposite end thereof for axial displacement by said hood, c. wherein said switch includes:

3. a pair of contacts mounted in said upper section extending in a normally open position and coupled to said lamp and battery means, and 4. a push button switch member extending within a bore in said upper section beyond said front end of said handle means for displacement against said contacts by said hood in its seated position on said handle means such that the electrical circuit is closed and said lamp illuminated.

d. wherein said upper section adjacent said switch is contoured in substantially conforming relationship with the shape of said cavity to facilitate the telescopic positionment therebetween, and e. further including a top extending radially from said handle means proximate said front end to facilitate use of said handle means by the user of the toy and retain said hood in position thereon.

10. A toy as defined in claim 9, wherein said hood has a contoured exterior configuration and said flexible means is secured to said hood at the upper end thereof and to said base, said flexible means being a connecting cord extending through an axial opening in said hood communicating with said cavity and having a knot formed to prevent removal therefrom.

* * * * *